US006049910A

United States Patent [19]

McCarter

[11] Patent Number: 6,049,910

[45] Date of Patent: Apr. 18, 2000

[54] ATHLETIC TRAINING GLOVE

[76] Inventor: Andre McCarter, 18333 Hatteras St., Ste. #43, Tarzana, Calif. 91356

[21] Appl. No.: 09/294,528

[22] Filed: Apr. 19, 1999

[51] Int. Cl.[7] ..... A41D 19/00

[52] U.S. Cl. ..... 2/161.1; 2/163; 473/450

[58] Field of Search ..... 2/16, 20, 21, 159, 2/161.1, 161.5, 161.6, 163; 473/450

[56] References Cited

U.S. PATENT DOCUMENTS

| | | |
|---|---|---|
| 2,845,628 | 10/1958 | Dell . |
| 3,496,573 | 2/1970 | Kuchar et al. . |
| 3,501,773 | 3/1970 | Stansberry et al. . |
| 3,640,532 | 2/1972 | Bauer . |
| 3,707,730 | 1/1973 | Slider . |
| 4,738,447 | 4/1988 | Brown . |
| 5,435,007 | 7/1995 | Kalvestran et al. . |
| 5,500,956 | 3/1996 | Schulkin et al. . |
| 5,636,381 | 6/1997 | Brogden . |
| 5,826,276 | 10/1998 | Garceau-Verbeck . |

*Primary Examiner*—Diana Oleksa
*Assistant Examiner*—Katherine M. Moran
*Attorney, Agent, or Firm*—Arter & Hadden LLP

[57] ABSTRACT

A training glove which degrades the athlete's sense of touch in certain areas of his hand ("no touch areas"), to thereby encourage and train the athlete to control the ball with his finger tips. The glove includes padding on the palm, the thumb and fingers, except for the thumb tip and finger tips. The padding insulates the athlete's sense of touch in the no touch areas. Because the glove is light weight and preserves the full flexibility of the hand, the glove may be worn in competition. Thus, the glove is useful both as a training device and a performance enhancement device in competition.

6 Claims, 2 Drawing Sheets

ATHLETIC TRAINING GLOVE

NOTICE OF COPYRIGHTS AND TRADE DRESS

A portion of the disclosure of this patent document contains material, which is subject to copyright protection. This patent document may show and/or describe matter which is or may become trade dress of the owner. The copyright and trade dress owner has no objection to the facsimile reproduction by any one of the patent disclosure, as it appears in the Patent and Trademark Office patent files or records, but otherwise reserves all copyright and trade dress rights whatsoever.

BACKGROUND OF THE INVENTION

1. Field of the Invention

This invention relates to a glove, and more particularly concerns an athletic training glove designed to improve an athlete's ball-handling abilities.

2. Description of Related Art

For many ball-oriented sports, an athlete's skill in ball-handling is critical. Relevant ball-oriented sports include basketball, football, baseball, volleyball, soccer, waterpolo and rugby. In these sports, it is important for the athlete to control the ball with his fingers.

In the game of basketball, skillful throwing or "shooting" the basketball through the hoop is achieved only with extensive practice and mastering of generally proven techniques. One objective of prolonged repetitious practice in actual shooting or in exercises which simulate shooting is to strengthen the several specific muscles involved in the shooting act.

In the "jump shot," two hands are used. One hand steadies the ball up until the ball reaches eye level, while the other hand actually shoots the ball. An important aspect of generally accepted technique is that the palm of the shooting hand should be arched so that the ball will be contacted by the fingertips and not by the palm. The proper amount of arching of the palm is generally acquired only after long experience and the attendant strengthening of the specific muscle groups involved.

Many training gloves for basketball and other sports have been provided with cut-off fingers. Many have pads in the palm to prevent palm contact with the ball.

U.S. Pat. No. 2,845,628 discloses a glove which fits over the fingers and leaves the thumb open. The device has no fingers, but is intended to develop proficiency in the player during practice sessions, in particular a basketball player, for accurate basketball shots and passes. The glove includes a heavy steel disk in the palm area to discourage any tendency to use the palms of the hand in handling the ball. The glove is not useful during competition, since the weight wears the athlete and the inflexibility of the disk overly limits movement.

U.S. Pat. No. 3,496,573 discloses a palm covering with a wedge in the palm. The palm covering is for use as a training device for basketball, volleyball, football and so on. This device does not fit on the fingers, but actually surrounds the palm. The device is not useful during competition because the wedge impedes basic functions such as dribbling.

U.S. Pat. No. 3,501,773 discloses an athletic glove that fits around the fingers, but the thumb is open. The fingers are part way up the finger base (to the first knuckle). The glove includes a pad in the palm. This glove is intended to aide in proper wristaction, but also is intended to aide in the proper passing and shooting of a basketball. This glove requires that the player handle the ball with the thumb and fingers rather than resting the ball on his palm. The reference indicates that only the fingertips should be used. The design of the pad in the palm is intended to force or condition the player to use the fingers. The glove is not useful during competition because it impedes the athletes ability to move his fingers.

U.S. Pat. No. 3,640,532 discloses a basketball teaching device. It is in the form of an elongated tube with loops which fit around the fingers, with the elongated tube remaining in the upper palm area. The device is not useful during competition because the tube impedes basic functions such as dribbling.

U.S. Pat. No. 3,707,730 discloses a glove in which the finger coverings extend up to the second knuckle, and the glove includes a strap between the thumb and the index finger. The strap positions the thumb in the proper position for the grasping of the basketball and the like. The purpose of this glove is to form the wearer's hand into a correct shape for shooting, dribbling and passing a basketball. The palm has a pad generally in the center thereof, but the rest of the glove seems to be of uniform thickness. The glove is not useful during competition because it impedes the athletes ability to move his fingers.

U.S. Pat. No. 4,738,447 describes a training glove for basketball players with cut-off finger portions and a rigid arch plate incorporated into the palm portion. It includes a weight positioned at the back of the hand. This glove trains the player not to contact the basketball with the palms of his hands, which forces the ball to be contacted by the spread fingers. Again, it is noted that the finger portions are essentially uniform and do not extend up past the first knuckle. The glove is not useful during competition because it impedes the athletes ability to move his fingers and the weight undesirably wears the athlete.

U.S. Pat. No. 5,435,007 describes essentially a wrist-guard which permits downward pivotal movement and restricts upward pivotal movement. While the fingers are cut-off, it is not intended as a training device for the fingers and in fact the palm pads are a series of buttons which are friction buttons.

U.S. Pat. No. 5,500,956 describes an athletic glove adapted for handling a basketball. This glove includes a palm layer with friction buttons trying to engage the basketball. The finger portions extend approximately ½ way to the first knuckle. This glove exposes the fingertips and the upper-knuckle portions of the fingers and thumb, while providing rotation on the remaining portion of the hand including specifically the palm. No palm pad is included to restrain the use of palm. The glove is intended to engage the ball at the palm, and thus discourages finger control.

U.S. Pat. No. 5,636,381 discloses a sports glove with splayed fingers. The glove has cut-off fingertips and thumb tips, but includes a webbing between the finger portions of the glove. The webbing is made of foam, rubber or other material which is normally used for padding. The webbing is secured between the finger inserts so that when the glove is worn, the webbing acts to force the player's fingers apart, which forces the player to adopt a proper ball handling posture. The webbing does not cause curvature of the fingers or otherwise improve the gripping aspects of the player's hand. The glove is not useful during competition because it impedes the athletes ability to move his fingers.

U.S. Pat. No. 5,826,276 discloses an ergonomic hand covering and grip enhancer. It is intended to be an ergonomic hand covering and gripping-enhancing glove. It provides protection support and has gripping capabilities. The thumb and finger portions do not appear to be covered, but two loops engage the fingers. The thickness of the glove appears to be uniform over the palm.

SUMMARY OF THE INVENTION

The above and other problems are solved in accordance with the present invention by a glove which degrades the athlete's sense of touch in certain areas of his hand ("no touch areas"), to thereby encourage and train the athlete to control the ball with his finger tips. The glove of the invention includes padding on the palm and fingers, except for the finger tips. The padding insulates the athlete's sense of touch in the no touch areas. Because the glove is light weight and preserves the full flexibility of the hand, the glove may be worn in competition. Thus, the glove is useful both as a training device and a performance enhancement device.

Other aspects of the invention include devices, systems, programs and methods related to the matter described above.

DESCRIPTION OF THE DRAWINGS

Further objects of this invention, together with additional features contributing thereto and advantages accruing therefrom, will be apparent from the following description of a preferred embodiment of the present invention which is shown in the accompanying drawings with like reference numerals indicating corresponding parts throughout and which is to be read in conjunction with the following drawings, wherein.

These and additional embodiments of the invention may now be better understood by turning to the following detailed description wherein an illustrated embodiment is described.

DETAILED DESCRIPTION OF THE INVENTION

Throughout this description, the preferred embodiment and examples shown should be considered as exemplars, rather than limitations on the apparatus and methods of the present invention.

Figure 1:
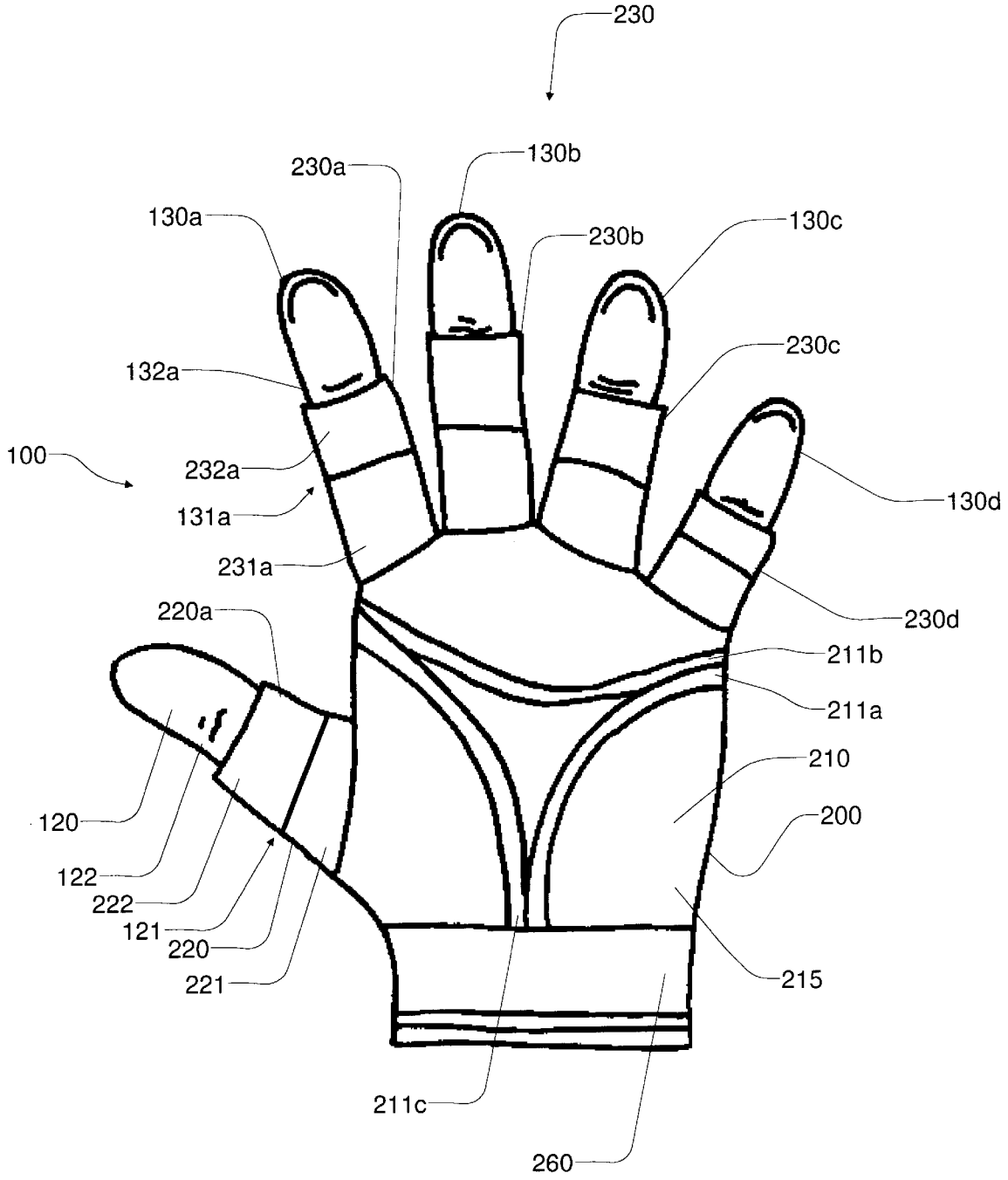
FIG. 1 is a top plan view of a hand wearing a glove of the invention.
Figure 2:
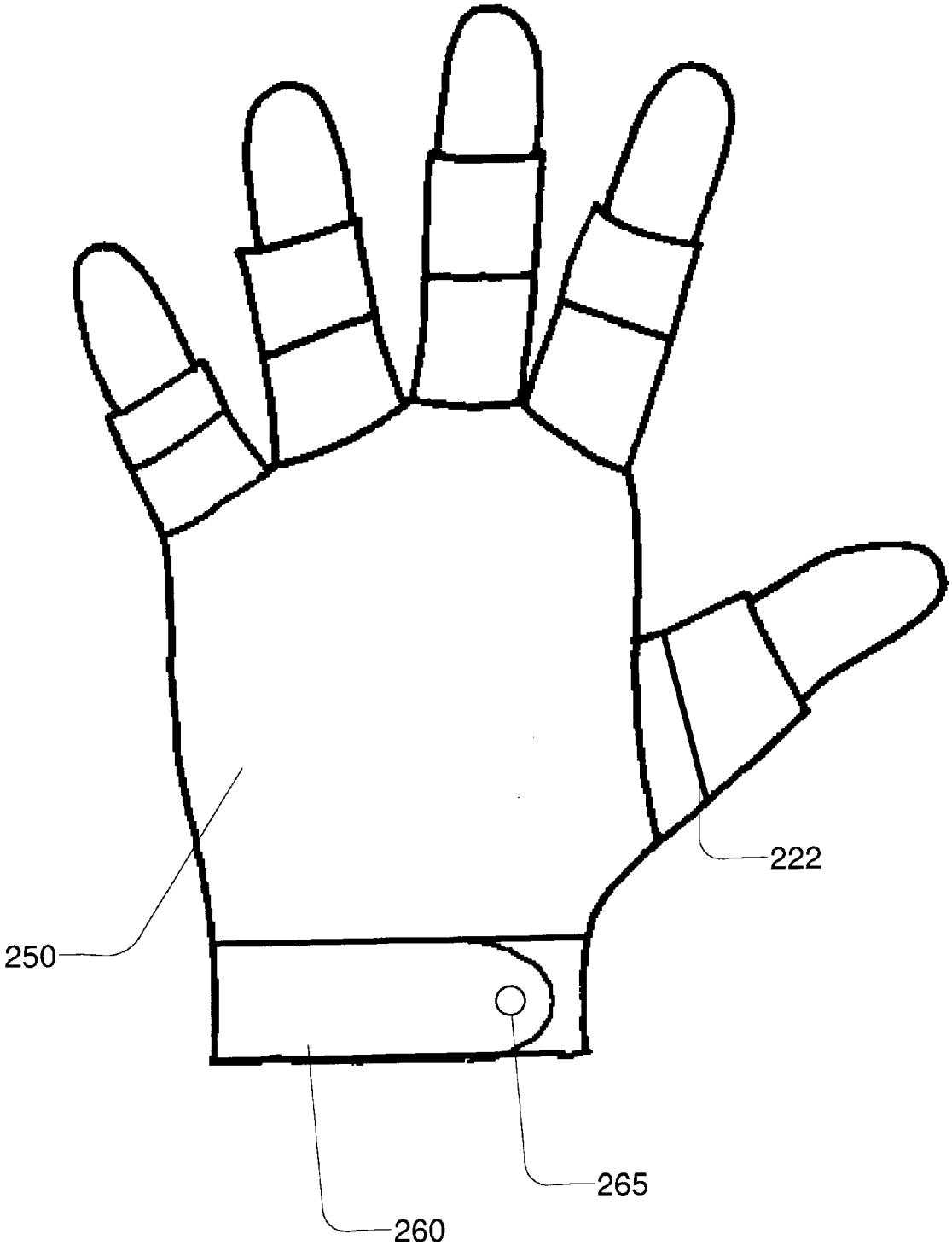
FIG. 2 is a bottom plan view of a hand wearing a glove of the invention.

Referring now to FIG. 1, there is shown a top plan view of an athlete's hand 100 wearing a glove 200 of the invention. The glove 200 comprises a palm portion 210, a thumb portion 220, a finger portion 230 and a back portion 250 (FIG. 2).

The palm portion 210 substantially covers the athlete's palm (hidden). The back portion 250 is secured to and lies opposite the palm portion 210 for holding the palm portion 210 to the athlete's palm and the glove generally on the athlete's hand 100. The palm portion 210 and the back portion 250 may be formed from a single piece of material, or may be separate and joined at seams.

The glove 200 further comprises a wrist region 260 which wraps around the front (FIG. 1) and back (FIG. 2) of the glove 200. The wrist region 260 preferably can be narrowed to secure the glove on the athlete's hand 100. Preferably, the tightness of the wrist region 260 may be adjusted, for example through provision of a snap 265 or other fastener such as Velcro. Preferably, the snap 260 or other faster is positioned on the back 250 of the glove 200.

The thumb portion 220 is secured to the palm portion 210 at the front of the athlete's hand 100 and the back portion 250 at the back of the athlete's hand 100. The thumb portion 220 comprises a thumb-accommodating sleeve 220*a* for receiving the thumb 120 of the athlete's hand 100. The thumb portion 220 is truncated at about the location of the second thumb joint 122 of the athlete's hand 100. The thumb-accommodating sleeve 220*a* of the thumb portion 220 comprises a first thumb section 221 and a second thumb section 222. The first thumb section 221 extends from the palm portion 210 to about the location of the first thumb joint 121 of the athlete's hand 100. The second thumb section 222 extends from about the location of the first thumb joint 121 of the athlete's hand 100 to the open end of the thumb-accommodating sleeve 220*a* at about the second thumb joint 122.

The finger portion 230 is secured to the palm portion 210 at the front of the athlete's hand 100 and the back portion 250 at the back of the athlete's hand 100. The finger portion 230 has four finger-accommodating sleeves 230*a*, 230*b*, 230*c*, 230*d*. The finger-accommodating sleeves 230*a*–230*d* receive the remaining four fingers 130*a*, 130*b*, 130*c*, 130*d* of the hand 100. Discussion of the finger-accommodating sleeves 230*a*–230*d* is made with respect to the finger-accommodating sleeve 230*a* for the pointing finger 130*a*, although it should be appreciated that the construction of the other finger-accommodating sleeves 230*b*–230*d* is comparable. The finger-accommodating sleeve 230*a* is truncated to about the location of the second joint 132*a* of the athlete's hand 100. The finger accommodating sleeve 230*a* comprises a first finger section 231*a* and a second finger section 232*a*. The first finger section 231*a* extends from the palm portion 210 to about the location of the first finger joint 131*a* of the athlete's hand 100. The second finger section 232*a* extends from about the location of the first finger joint 131*a* of the athlete's hand 100 to the open end of the finger-accommodating sleeve 230*a*.

As mentioned above, the glove 200 includes a number of "no touch" areas. The no touch areas of the glove 200 comprise the palm portion 210, the first thumb section 221, the second thumb section 222, the first finger sections 231 and the second finger sections 232.

The glove 200 is preferably made from a number of different materials, depending on the respective portion of the glove 200. However, it is within the scope of the invention for the glove 200 to be made from a single material, wherein the thickness and/or density of the material are varied to meet the functional requirements of the invention. Through proper selection of materials, the glove 200 substantially reduces the athlete's sense of touch in the no touch areas 210, 221, 222, 231, 232 and thereby discourages the athlete from using all but his fingertips for ball control. By "fingertips," the tip of the thumb is also intended to be included.

The back 250 of the glove 200 is made from a lightweight, porous, strong, flexible fabric such as spandex.

Preferably, the no touch areas 210, 221, 222, 231, 232 are covered with a light cotton, rawhide-like fabric. The light cotton, rawhide-like fabric covering of the no touch areas 210, 221, 222, 231, 232 does not effectively prevent the athlete of his sense of touch in the no touch areas 210, 221, 222, 231, 232. Thus, padding is included in the no touch areas 210, 221, 222, 231, 232. This padding preferably comprises brushed cloth cotton fabric, which is like terry-cloth. Closed-cell foam padding inserts may also be used.

The palm portion 210 includes a padding section 215. The padding section 215 of the palm portion 210 has light but firm padding. The density and thickness of the padding section 215 of the palm portion 210 are sufficient to substantially insulate the sense of touch of the ball from the palm 110. Preferably, the thickness of the padding varies from ½ inch in the center of the palm portion 210 to about ⅜ inch at the edges of the palm portion 210 at the fingers.

Preferably, the palm portion 210 further includes representations 211*a*, 211*b*, 211*c* of the main lines of the palm of a hand. The representations 211*a*, 211*b*, 211*c* provide the athlete with references which assist the athlete in proper positioning of his hand 100 with respect to a ball.

Other parts of the glove 200 also include padding. Padding on the thumb section 220 and the finger section 230 prevent the athlete from the sense of touch at these parts of his hand. The first thumb section 221 and the first finger sections 231 have padding with a density about half of the density of the padding in the padding portion 215 of the palm section 210. This padding is preferably about ¼ inch thick. The second thumb section 222 and the second finger sections 232 have padding with a density slightly less than the thickness of the padding in the first thumb section 221 and the first finger sections 231.

The padding in the glove 200 takes away from the athlete his sense of feeling or sensitivity in the padded areas. This then forces the athlete to rely upon his fingertips to feel the ball and handle any actions with the ball. Thus, the fingertips become the focal point when handling a ball.

In contrast to prior art devices, the glove of the invention does not force the athlete to shape his hand in a particular manner. On the contrary, full freedom of movement is preserved. The athlete may dribble, bend his fingers and use his hands for all normal functions. Thus, the glove of the invention may be worn in competition. Better still, when the glove is worn in competition, the glove will improve the athlete's performance.

Rather than act as a fully physical training aid, the glove of the invention is more properly considered a psychological training aid. Because the glove 200 insulates the sense of touch in the no touch areas, the athlete is discouraged from using the no touch areas of his hand. Thus, the glove indirectly encourages the athlete to use his finger tips for ball control.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications and alterations should therefore be seen as within the scope of the present invention.

It is claimed:

1. An athletic training glove for use in training an athlete to properly handle a ball in sports in which the fingers and thumb should be used for principal control of the ball, the glove to be worn on an athlete's hand and comprising:

(a) a palm portion for substantially covering the athlete's palm, the palm portion including a first padding section;

(b) a back portion secured to and opposite the palm portion for holding the palm portion to the athlete's palm and the glove generally on the athlete's hand;

(c) a thumb portion secured to the palm portion and the back portion, the thumb portion comprising a thumb-accommodating sleeve for receiving the thumb of the athlete's hand, the thumb portion being truncated at about the location of the second thumb joint of the athlete's hand, the thumb-accommodating sleeve comprising:

(i) a first thumb section extending from the palm portion to about the location of the first thumb joint of the athlete's hand and including a second padding section, and (ii) a second thumb section extending from about the location of the first thumb joint of the athlete's hand to the open end of the thumb-accommodating sleeve and including a third padding section;

(d) a finger portion secured to the palm portion and the back portion, the finger portion having four finger-accommodating sleeves for receiving the remaining four fingers of the hand, the finger-accommodating sleeves being truncated to about the locations of the second joints of the athlete's hand, each finger-accommodating sleeve comprising:

(i) a first finger section extending from the palm portion to about the location of the respective first finger joint of the athlete's hand and including a fourth padding section, and (ii) a second finger section extending from about the location of the respective first finger joint of the athlete's hand to the open end of the finger-accommodating sleeve and including a fifth padding section;

wherein the first padding section, the second padding section, the third padding section, the fourth padding section and the fifth padding section insulate the respective parts of the hand underneath the respective padding sections from the sense of touch, and whereby substantially full flexibility of hand movement is permitted by the glove when worn.

2. The athletic training glove of claim 1 wherein:

the first padding section has a first thickness, the second padding section has a second thickness about half of the first thickness, the third padding section have a third thickness about half of the first thickness, the fourth padding sections have a fourth thickness slightly less than the second thickness, and the fifth padding sections have a fifth thickness slightly less than the third thickness.

3. The athletic training glove of claim 1 wherein the palm portion and the back portion are comprised of light-weight porous strong fabric.

4. The athletic training glove of claim 3 wherein the fabric of the back portion comprises spandex.

5. The athletic training glove of claim 1 wherein the first padding section, the second padding section, the third padding section, the fourth padding section and the fifth padding section comprise brushed cloth cotton fabric.

6. The athletic training glove of claim 1 wherein the palm portion, thumb portion and finger portion comprise light cotton, rawhide-like fabric.

* * * * *